United States Patent [19]

Rizzutto et al.

[11] 4,425,679

[45] Jan. 17, 1984

[54] BOUTONNIERE ATTACHING PIN

[76] Inventors: Junko Rizzutto, 5315 Raymond Telles, El Paso, Tex. 85224; Timothy E. McGlew, 2801 N. Dakota St., Chandler, Ariz. 85224

[21] Appl. No.: 412,516

[22] Filed: Aug. 30, 1982

[51] Int. Cl.[3] ..... A45F 5/08

[52] U.S. Cl. ..... 24/6; 24/150 B

[58] Field of Search ..... 24/6, 150 B, 150 R, 24/13, 48, 60, 103; 132/50 B, 68; 411/457

[56] References Cited

U.S. PATENT DOCUMENTS

| | | | |
|---|---|---|---|
| 508,149 | 11/1893 | Schumm | 24/6 |
| 596,221 | 12/1897 | Sturtevant | 24/6 |
| 758,289 | 4/1904 | Wittigschlager | 132/68 |
| 871,413 | 11/1907 | Keane | 24/150 B |
| 1,047,556 | 12/1912 | Norton | 24/150 B |
| 1,554,527 | 9/1925 | Saalfrank | 24/150 B |
| 1,708,005 | 4/1929 | Wilson | 24/150 B |
| 2,145,531 | 1/1939 | Shuko | 24/6 |
| 2,549,883 | 4/1951 | Biegajski | 24/103 |

FOREIGN PATENT DOCUMENTS

| | | | |
|---|---|---|---|
| 2252094 | 5/1974 | Fed. Rep. of Germany | 132/50 |
| 440 | of 1873 | United Kingdom | 24/6 |

*Primary Examiner*—John J. Wilson

*Attorney, Agent, or Firm*—Harry M. Weiss

[57] ABSTRACT

This disclosure relates to an attachment pin or needle which incorporates a plurality of more than two parallel prongs to serve as a device to fasten a boutonniere, floral arrangement or other non-related article to personal clothing, to a floral display, or to any puncturable supporting means, so that the flower or other material remains securely attached, and so that a variety of sizes of boutonniere may be grasped.

1 Claim, 4 Drawing Figures

BOUTONNIERE ATTACHING PIN

BACKGROUND OF THE INVENTION

1. Field of the Invention

This invention relates generally to attachment pins and more specifically to multiple-pronged pins for the affixing of flowers or other objects to clothing or other puncturable supporting means.

2. Description of the Prior Art

In the past, single-prong and two-prong pins have been used to affix boutonnieres and other objects to clothing, floral displays and other puncturable supporting surfaces, as described in U.S. Pat. No. 1,554,527 (R. B. Saalfrink), U.S. Pat. No. 1,708,005 (C. P. Wilson) and U.S. Pat. No. 2,145,531 (S. Shuko). These devices differed primarily in the curvature or shape adjoining means, or supporting member, between the two prongs. In general, the joining means acted as the holder of the boutonniere or other object. Under various circumstances, the supporting member-boutonniere connection become loose or insecure, and permitted the boutonniere or other object to move or slip with respect to the supporting surface.

Prior-art pins were intended to accomodate a specific size of stem, or a narrow range of stem-or other object-sizes. Thus, a selection of pin sizes was required to be kept in stock so as to accomodate differing stem or object thicknesses.

The retentive force of prior art single-or two-prong pins was limited by the length of engagement between the prongs and the puncturable support surface, with a greater length of prong giving greater security.

A need existed for a pin which would more securely engage the puncturable means into which it was inserted, without the need for excessive length, and could more securely grasp the boutonniere or other object which is to be attached thereby to the puncturable support surface.

A need also existed for a pin capable of securely grasping a broad range of stem or other object sizes.

SUMMARY OF THE INVENTION

In accordance with one embodiment of this invention, it is an object to provide a pin with greater attachment stability than a one-or two-prong pin.

It is another object to provide a pin with a plurality of prongs greater than two, one or more of which may puncture and secure the boutonniere or other object so as to prevent relative movement between the boutonniere or other object and the puncturable support means to which it is attached.

It is yet another object to provide a pin with a plurality of prongs greater than two, wherein the spacing between adjacent prongs is narrower than between the outermost prongs corresponding to a prior-art two-prong pin, permitting thereby the more secure grasping of thin or narrow boutonniere stems or other narrow objects, and/or the intertwining of portions of the stem or other object amongst the prongs so as to prevent relative motion between said boutonniere or other object and the puncturable support means to which it is attached.

In accordance with another embodiment of this invention, it is an object to provide a pin as in the first embodiment, wherein a plurality of prong spacings are provided to accomodate a wide range of stem or other object thicknesses.

In accordance with each embodiment of this invention, it is an object to provide sufficient retentive force by distributing said force among a larger plurality of prongs than two, rather than the extension of length of prior-art one-prong or two-prong pins.

DESCRIPTION OF THE PREFERRED EMBODIMENTS

In accord with one embodiment of this invention, a mounting apparatus for mounting a stem-supported boutonniere upon a supporting surface is disclosed, comprising: a spine; and pins means having multiple parallel pins projecting orthogonally in a common direction from the spine so that the stem can be forked between the pins when the pins are inserted into the surface to thereby support the boutonniere upon the surface.

In accord with another embodiment of the invention, a method for mounting any of a variety of sizes of stem-supported boutonnieres upon a supporting surface is disclosed, comprising the steps of: defining a spine; projecting at least three parallel pins in a common direction from the spine; providing differing distances between adjacent pairs of the pins; forking the stem between the pair of the pins having the distance therebetween most closely corresponding to the size of the stem; and pinning the pins to the supporting surface so that the stem is trapped thereby against the surface.

The foregoing and other objects, features and advantages will be apparent from the following, more particular, description of the preferred embodiments of the invention, as illustrated in the accompanying drawings.

THE SPECIFICATION

Figure 1:
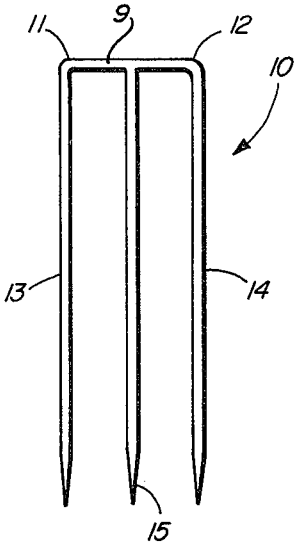
FIG. 1 is a side view of the boutonniere attaching needle.

In FIG. 1, an embodiment of the mounting apparatus is shown generally, in an elevational view, by reference number 10. A spine 9 provides the frame for the mounting apparatus 10. A series of sharpened prongs, as respectively shown by reference numbers 13, 14 and 15, orthogonally project in a common direction from the spine 9. The outer prongs 13, 14, flank the central prong 15. The outer prongs 13, 14 can conveniently be formed by bends in the spine 9, as shown at 11 and 12.

Figure 2:
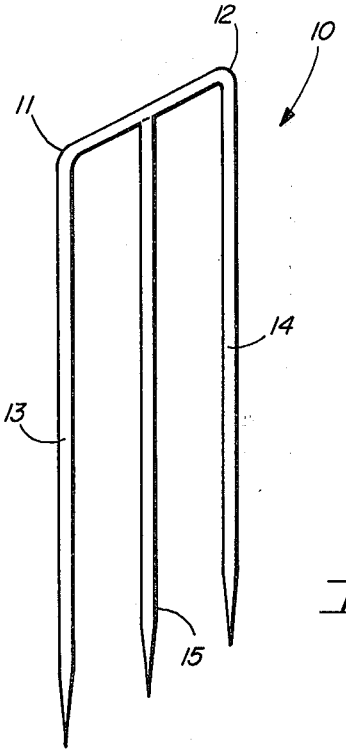
FIG. 2 is a perspective view of the boutonniere attaching needle.

FIG. 2 is an elevational view of the mounting apparatus 10 of FIG. 1.

Figure 3:
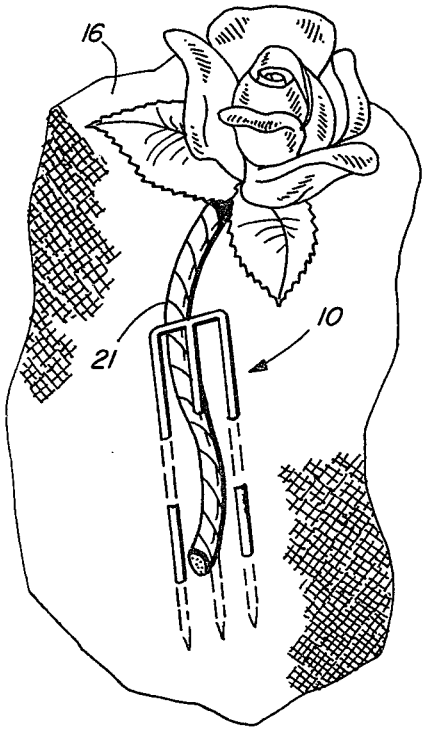
FIG. 3 is a perspective view of a three-prong pin puncturably securing a boutonniere stem to a puncturable support means.

FIG. 3 shows a first method of using the mounting apparatus 10 of FIG. 1. The central prong 15 is inserted through a stem 21 of a boutonniere. As shown, the central prong 15 projects through the stem 21, into the substance of the supporting surface 16. The outboard prongs 13, 14 also similarly engage the supporting surface 16. The combined engagement of the prongs 13, 14, 15 provides rotational support to prevent the movement created by the boutonniere from twisting the stem 21, and supporting central prong 15, with respect to the supporting surface 16.

Figure 4:
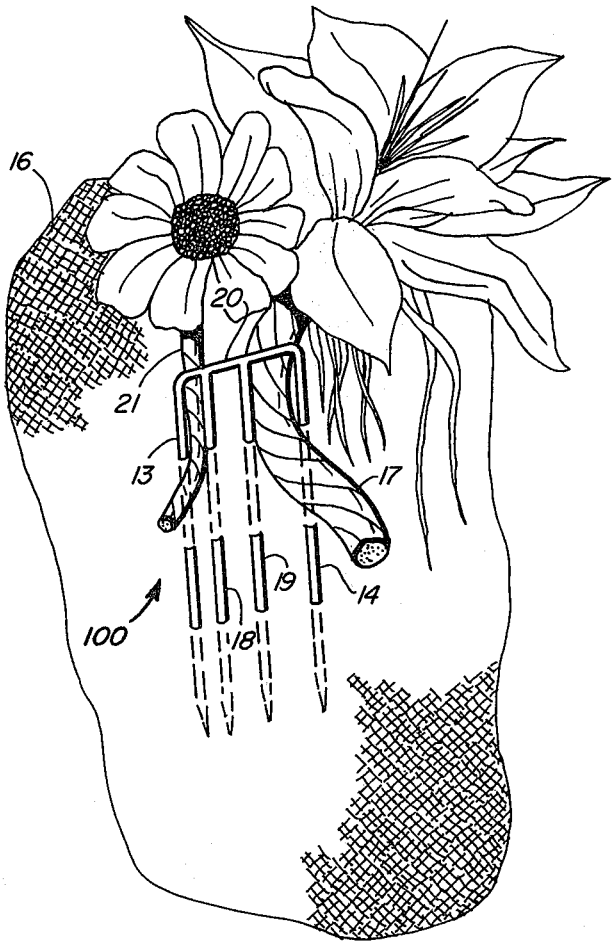
FIG. 4 is a perspective view of a pin having a plurality of prongs greater than three, showing how thin stems are grasped between closely spaced prongs, and thick stems are grasped between widely spaced stems.

Referring then to FIG. 4, a second embodiment of the mounting apparatus is shown generally by reference number 100. The mounting apparatus 100 also employs the spine 9, and orthogonally projecting prongs 13, 14. Additionally, the mounting apparatus 100 utilizes multiple central prongs, as shown by reference number 18, 19. A critical aspect of the second embodiment of the mounting apparatus 100 involves the spacing between adjacent pairs of the prongs, in that the variety of suitable spacings allows boutonnieres having various sizes of stems to be attached to the supporting surface 16.

As shown in FIG. 4, a single, thicker, stem 17 can be forked between two of the prongs 14, 19. Additional, possibly thinner, stems 21 can be forked between adjacent pairs of the prongs 13, 18. It will be appreciated that, alternatively, the prongs 13, 14, 18, 19 could be inserted through the stems 17, 21, as shown in FIG. 3. Thus there are provided alternate devices for advantageously supporting one or more boutonnieres, having any of a variety of stem sizes, in rotational stability on a supporting surface.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A method for mounting any of a variety of sizes of stem-supported boutonnieres upon a supporting surface, comprising the steps of:

forming a spine with at least three parallel pins projecting in a common direction from said spine;

providing differing distances between adjacent pairs of said pins;

forking said stem between the pair of said pins having the distance therebetween most closely corresponding to the size of said stem; and pinning said pins to said supporting surface so that said stem is trapped thereby against said surface.

* * * * *